US007730674B1

(12) United States Patent
Gernstein

(10) Patent No.: US 7,730,674 B1
(45) Date of Patent: Jun. 8, 2010

(54) WINDOW WELL

(76) Inventor: Dan H. Gernstein, 2306 N. 160th St., Omaha, NE (US) 68116

( * ) Notice: Subject to any disclaimer, the term of this patent is extended or adjusted under 35 U.S.C. 154(b) by 519 days.

(21) Appl. No.: 11/786,708

(22) Filed: Apr. 12, 2007

Related U.S. Application Data

(63) Continuation-in-part of application No. 11/598,344, filed on Nov. 13, 2006.

(60) Provisional application No. 60/849,709, filed on Oct. 5, 2006.

(51) Int. Cl.
*E04F 17/06* (2006.01)

(52) U.S. Cl. ..... 52/107; 52/19

(58) Field of Classification Search ..... 52/19, 52/169.1, 170, 169.6, 169.7, 182, 184, 190, 52/245; 182/53, 194, 230
See application file for complete search history.

(56) References Cited

U.S. PATENT DOCUMENTS 2,898,638 A * 8/1959 Druckhamer ..... 52/107
5,323,874 A * 6/1994 Warren et al. ..... 182/129
6,484,455 B1 * 11/2002 Poole ..... 52/107
6,581,338 B2 * 6/2003 Koenig et al. ..... 52/107
6,915,612 B2 * 7/2005 Oakley ..... 52/107
7,171,786 B2 * 2/2007 George ..... 52/107
7,356,968 B2 * 4/2008 Joyce et al. ..... 52/19
2003/0182877 A1 * 10/2003 Worth ..... 52/107

* cited by examiner

*Primary Examiner*—Brian E Glessner
*Assistant Examiner*—Patrick Maestri
(74) *Attorney, Agent, or Firm*—Dennis L. Thomte; Thomte Patent Law Office LLC

(57) ABSTRACT

A window well for use by a person to escape through a window formed in a basement wall including a generally U-shaped body member having upper and lower ends and inner and outer ends. The open upper end of the body member has a spacer and a removable lid mounted thereon. The body member is comprised of a composite material such as fiberglass. A stair structure is positioned adjacent the inner surface of the front wall of the body member and is also comprised of a composite material.

18 Claims, 4 Drawing Sheets

WINDOW WELL

CROSS-REFERENCE TO RELATED APPLICATION

This is a continuation-in-part application of Petitioner's earlier application Ser. No. 11/598,344 filed Nov. 13, 2006, entitled "WINDOW WELL".

This application also claims the benefit of U.S. Provisional Application Ser. No. 60/849,709 entitled "WINDOW WELL" filed Oct. 5, 2006, the disclosure of which is hereby incorporated herein by reference.

BACKGROUND OF THE INVENTION

1. Field of the Invention

This invention relates to a window well and more particularly to a window well which provides an emergency escape structure from a basement window. Even more particularly, the window well of this invention includes a stair structure which is secured to the inside surface of the front wall thereof to assist a person to climb upwardly and outwardly from the interior of the window well.

2. Description of the Related Art

Many city or municipal codes require that if a bedroom is located in a basement, there must be some means of escape from the bedroom. In the past, it is believed that large window wells have been provided which do provide a means of escaping from a basement bedroom window with the same being constructed of timbers, ties, concrete blocks, etc. It is believed that the prior art structures are difficult to build or construct, are not aesthetically pleasing in appearance are not durable, and do not have a cover at the top thereof which prevents debris from accumulating in the window well.

Further, it is believed that none of the prior art window wells has a stair structure associated therewith which may be used by a person to climb upwardly and outwardly from the interior of the window well.

SUMMARY OF THE INVENTION

A window well for a basement window is provided which is constructed of a fiberglass material and which is sufficiently large enough to provide an emergency escape route from a basement bedroom window. The window well structure of this invention includes a bottom having a drain opening formed therein. The window well includes a spacer element which extends between the upper ends of the opposite walls thereof adjacent the basement wall and a translucent or transparent lid or cover positioned outwardly of the spacer. The spacer maintains the window well structure in its desired configuration. The lid permits light to pass therethrough with the spacer and lid preventing debris from accumulating in the window well. The lid is removable from the inside of the window well by simply pushing upwardly thereagainst. A stair structure is secured to the inside surface of the front wall of the window well to provide a means by which a person may climb upwardly and outwardly from the interior of the window well.

It is therefore a principal object of the invention to provide an improved window well.

A further object of the invention is to provide a window well which provides an emergency access from a basement bedroom window.

A further object of the invention is to provide a window well structure which is durable in use and will not rot in the ground.

Still another object of the invention is to provide a window well which is aesthetically pleasing.

Yet another object of the invention is to provide a window well of the type described which includes a lid which is easily removable from the inside of the well to facilitate egress therethrough.

Still another object of the invention is to provide a window well of the type described which is constructed primarily of fiberglass.

Still another object of the invention is to provide a window well of the type described which is easy to ship and easy to install.

Yet another object of the invention is to provide a window well of the type described above and which includes a stair structure secured to the inside surface of the front portion to provide a means for a person to climb from the interior of the window well.

Still another object of the invention is to provide a stair structure for a window well which includes steps and handholds.

These and other objects will be apparent to those skilled in the art.

DETAILED DESCRIPTION OF THE INVENTION

Figure 1:
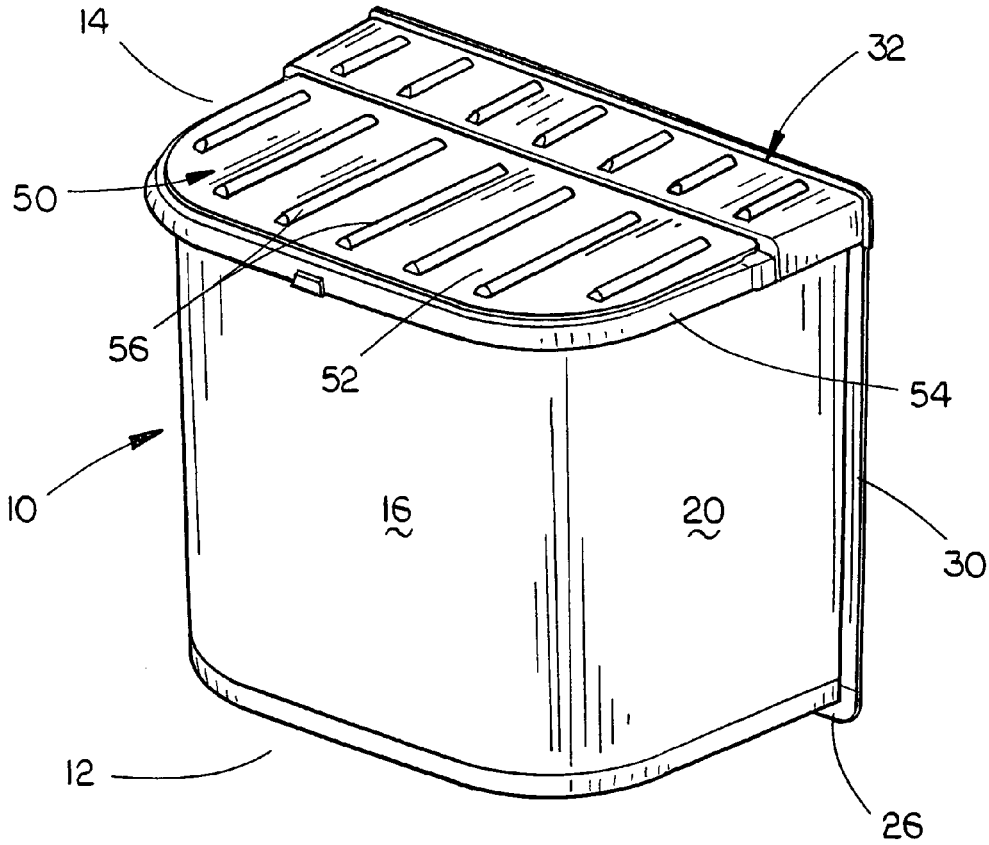
FIG. 1 is a front perspective view of the window well of this invention with the spacer and lid mounted thereon.
Figure 2:
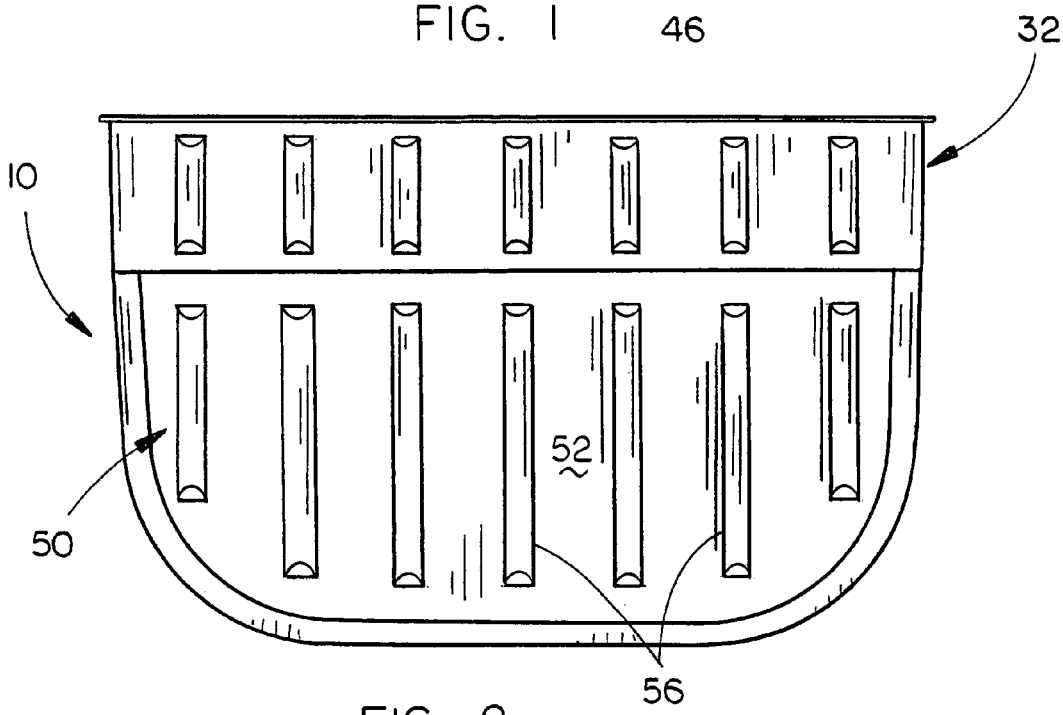
FIG. 2 is a top view of the window well of FIG. 1.

The window well of this invention is referred to generally by the reference numeral 10 which is generally U-shaped in cross-section. Window well 10 is of one-piece construction and includes a lower end 12, an upper end 14, a front portion 16 and opposite side portions 18 and 20 for purposes of description. The upper end 14 of window well 10 is open while the lower end 12 of window well 10 is preferably closed by means of a fiberglass bottom or floor 22 secured to the lower end of the window well by means of glue or other convenient means. Bottom 22 is provided with a drain opening 24. The rearward end of bottom 22 is provided with a flange 26 to provide a mounting surface for attachment to the exterior wall of the basement to which the window well will be attached. The rearward ends of side portions 18 and 20 are provided with laterally extending flanges 28 and 30, respectively, to provide a mounting surface for attachment to the exterior of the basement wall.

The window well 10 is comprised of a fiberglass material having a gel coat thereon which is treated to prevent the material from fading. The fiberglass material is preferably glass reinforced in conventional fashion for strengthening purposes. The flanges 26, 28 and 30 are preferably comprised of an aluminum material and would be embedded in the fiberglass material. The flanges will normally have openings formed therein so that anchors or other fasteners may be extended therethrough to secure the well to the exterior surface of the basement wall. Preferably, the height of the window well 10 is between forty-eight inches and sixty inches with the width between the side portions being preferably fifty-four inches.

Figure 4:
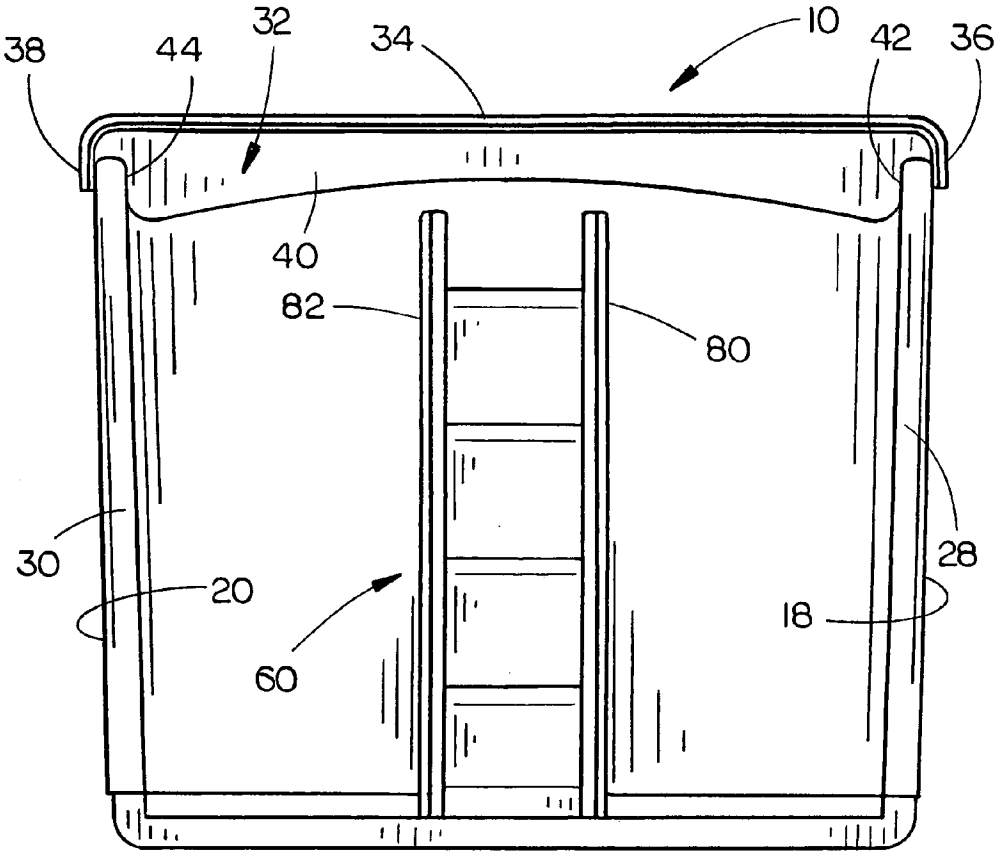
FIG. 4 is a rear view of the window well of FIG. 1.
Figure 3:
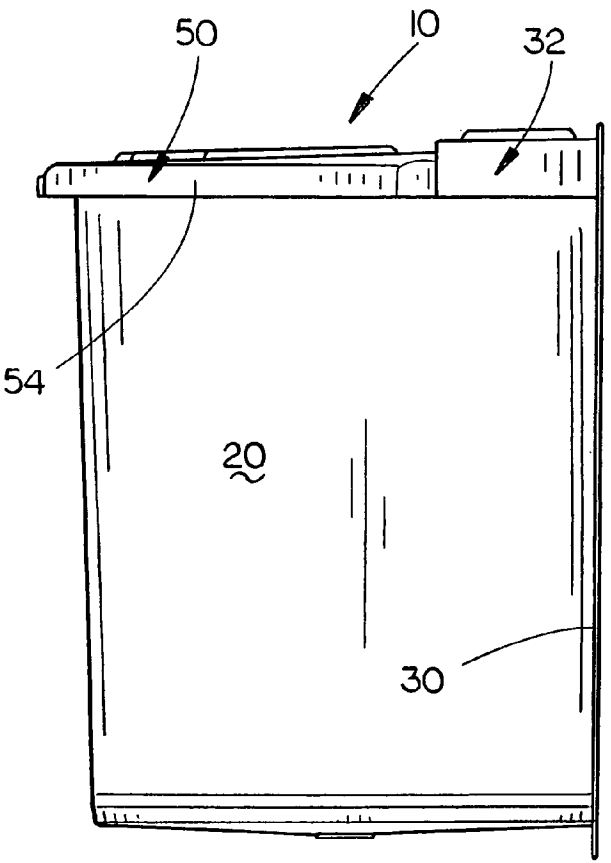
FIG. 3 is a left side view of the window well of FIG. 1.
Figure 5:
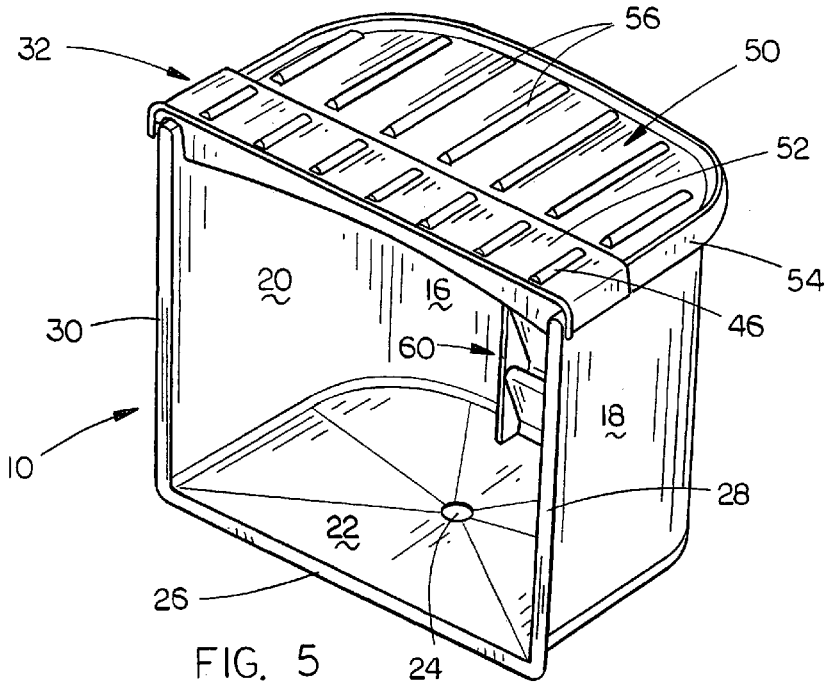
FIG. 5 is a rear perspective view of the window well of FIG. 1.
Figure 6:
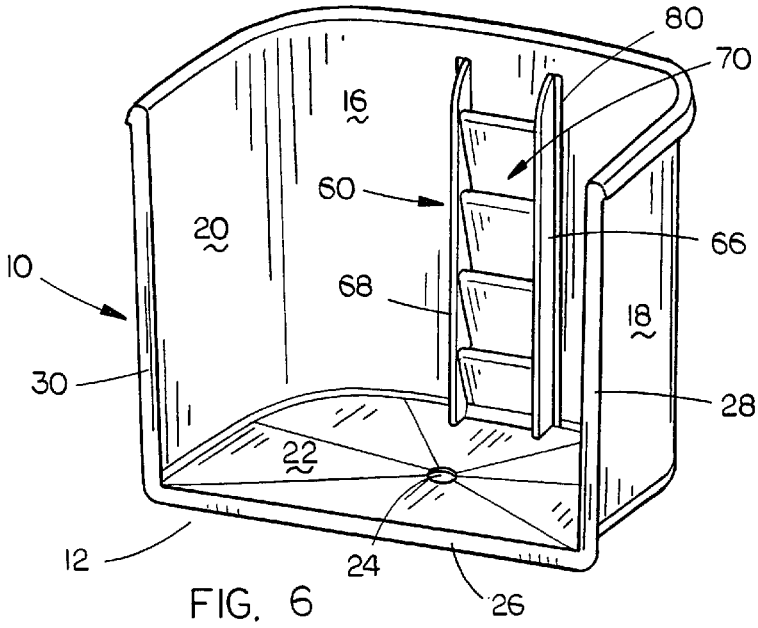
FIG. 6 is a rear perspective view of the window well with the spacer and lid removed.
Figure 7:
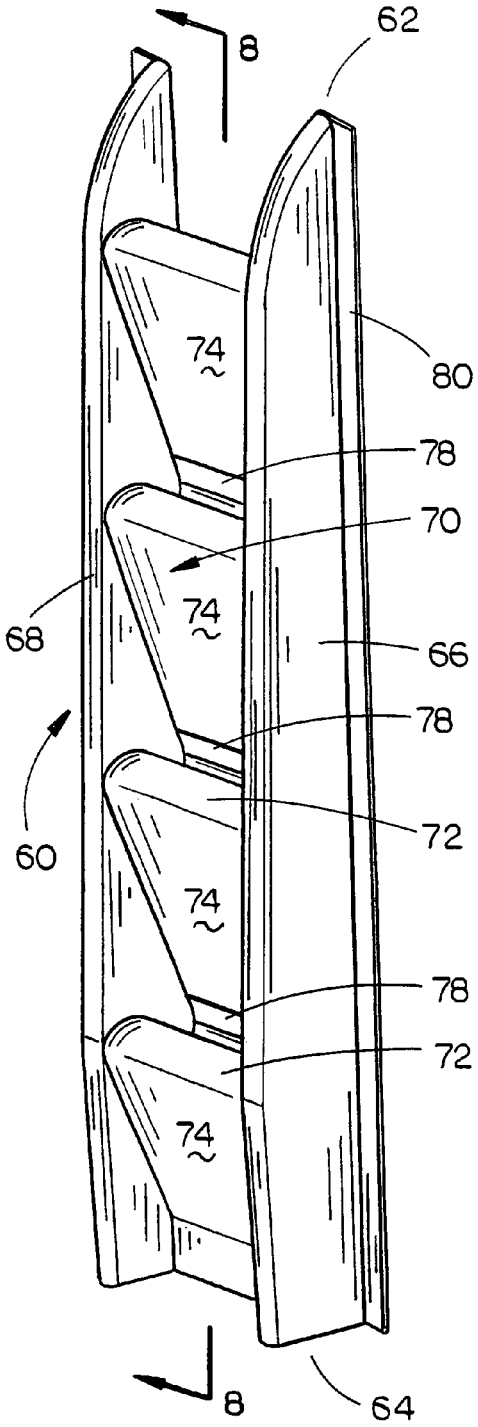
FIG. 7 is a perspective view of the stair structure of this invention.
Figure 8:
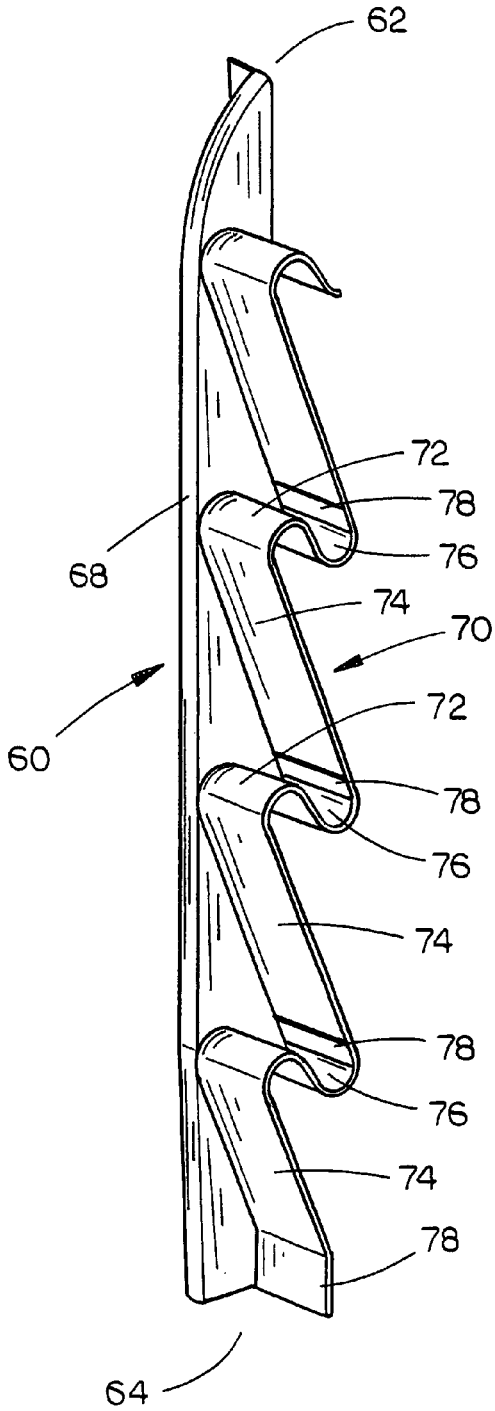
FIG. 8 is a cut away perspective view of the stair structure of this invention.

The window well 10 is provided with a fiberglass spacer 32 which includes a top wall 34 and downwardly depending sides 36 and 38. The downwardly depending sides 36 and 38 embrace the upper end of the window well 10 as seen in FIG. 4. The underside of spacer 32 is provided with a member 40 having recesses 42 and 44 at its opposite ends which receive the upper ends of side portions 18 and 20, respectively, and maintains the shape of the window well 10 against pressures within the ground. The spacer 32 ensures that the side portions 18 and 20 may not move towards one another or move away from one another. The spacer 32 is preferably glued or otherwise secured to the upper ends of the window well 10 at the factory. The spacer 32 includes a plurality of longitudinally extending reinforcing ribs 46, as seen in the drawings. The outer end of spacer 32 is provided with a slot or recess formed therein adapted to receive the inner end of lid or cover 50 which is preferably comprised of a translucent lexan material. Lid 50 includes an upper portion 52 having a downwardly depending flange 54 extending therefrom which embraces the upper ends of side portions 18 and 20 and front portion 16. The lid 50 is preferably provided with a plurality of longitudinally extending reinforcing ribs 56 with the rearward end of lid 50 being received in the slot or recess 48, as described above, to maintain the lid in position so as to prevent rainwater or debris from entering the interior of the window well 10. The lid or cover 50 may be easily removed from the window well 10 from the inside of the window well by simply pressing upwardly thereon.

Normally, the window well 10 will be installed or mounted on the exterior surface of the basement wall prior to backfilling with the interior of the window well 10 being in communication with a basement window. Should water somehow enter the interior of the window well 10, it may drain therefrom through the drain opening 24. Regardless of pressures within the ground such as may be created by backfill or water, the spacer 32 maintains the shape of the window well 10. As previously stated, the flanges 26, 28 and 30 will be anchored or otherwise secured to the exterior surface of the basement wall to maintain the window well 10 in position. Normally, the lid 50 will be installed on the window well so as to prevent debris from entering the window well. The translucent characteristic of the lid 50 enables sunlight to pass therethrough to permit light to enter the basement window.

The numeral 60 refers to a stair or ladder structure, preferably comprised of a fiberglass material, and which is secured to the inside surface of front portion 16. For purposes of description, stair structure 16 may be described as having an upper end 62 and a lower end 64. Stair structure 16 includes a pair of spaced-apart side member 66 and 68 and a step-handhold portion 70 extending therebetween. Step-handhold portion 70 is comprised of a plurality of vertically spaced-apart steps 72 connected together by webs 74. As seen in the drawings, the area behind the steps 72 is recessed at 76 to provide handholds to enable a person to grasp the step/handhold to enable the person to easily climb upwardly and outwardly from the interior of the window well.

The lower ends of the webs 74 are provided with flat surfaces 78, one side of which engages the inside surface of front portion 16. Double-faced tape is positioned between the surfaces 78 and the inside surface of the front portion 16 to attach the stair structure 60 to the inside surface of front portion 16. Preferably, each of the side members 66 and 68 are provided with laterally extending flanges 80 and 82 which may also be attached to the inside surface of front portion 16 by double-faced tape and/or pop rivets. As seen, the lower ends of side member 66 and 68 rest upon the floor 22 of the window well 10. As also seen, it is preferred that the upper ends of side member 66 and 68 are tapered at 84 and 86, respectively.

In the event that a person must escape from the house during a fire or the like, the person will open the basement window and enter the interior of the window well 10. The person will push upwardly on the lid 50 so that the person may climb out of the window well through the open upper end of the window well 10 by utilizing the stair structure 60 which not only provides steps 72, but handholds as well.

Not only is the window well 10 of this invention easy to ship, but it is easy to install on the basement wall. A certain amount of the upper portion of the window well 10 will be exposed above the ground surface and the fiberglass composition of the window well will be aesthetically pleasing.

Thus it can be seen that the invention accomplishes at least all of its stated objectives.

I claim:

1. A window well for use by a person to escape through a window formed in a basement wall, comprising:

a generally U-shaped body member including an outer wall, opposite side walls, and an open upper end;

said walls having inner and outer surfaces;

said body member having upper and lower ends;

said side walls having vertically disposed inner edges;

an upstanding stair structure positioned at said inner surface of said outer wall;

said stair structure including a plurality of vertically spaced-apart, inverted U-shaped steps;

each of said steps having upper and lower ends;

each of said steps having an inverted U-shaped upper end portion with forward and rearward sides, a web extending downwardly and rearwardly from said forward side of said U-shaped upper end portion, and a lower end portion which is disposed rearwardly of the upper end portion of a step positioned therebelow to provide a handhold at the upper end of each of said steps;

a spacer member secured to said upper ends of said side walls adjacent said inner edges thereof and extending therebetween to prevent relative movement therebetween;

said spacer member having inner and outer ends and opposite side edges;

a lid removably positioned on said upper end of said outer wall and said upper ends of said side walls outwardly of said spacer;

said body member of said stair structure being comprised of a composite material.

2. The window well of claim 1 wherein said composite material comprises a fiberglass material.

3. The window well of claim 1 wherein said composite material comprises a reinforced fiberglass material.

4. The window well of claim 1 wherein said composite material of said window well has a gel coat thereon.

5. The window well of claim 1 wherein said body member has a bottom wall secured thereto.

6. The window well of claim 5 wherein said body member has a drain opening formed therein.

7. The window well of claim 1 wherein said spacer is comprised of a composite material.

8. The window well of claim 7 wherein said spacer has reinforcing ribs formed thereon.

9. The window well of claim 1 wherein said spacer includes downwardly extending portions at its side edges which embrace the upper ends of said side walls.

10. The window well of claim 1 wherein said lid is translucent.

11. The window well of claim 10 wherein said lid has reinforcing ribs formed thereon.

12. The window well of claim 1 wherein said lid has an inner end which is removably secured to said spacer.

13. The window well of claim 1 wherein said side walls have metal flanges embedded therein for attachment to the exterior surface of the basement wall.

14. The window well of claim 5 wherein said bottom wall has a metal flange embedded therein for attachment to the exterior surface of the basement wall.

15. The window well of claim 14 wherein said bottom wall is formed of a composite material such as fiberglass.

16. The window well of claim 1 wherein said stair structure is attached to said outer wall.

17. The window well of claim 1 wherein said stair structure comprises a pair of horizontally spaced-apart side members having a central portion secured thereto and extending therebetween, said central portion having said steps formed therein.

18. The window well of claim 17 wherein said stair structure is of one-piece molded construction.

* * * * *